US005772399A

United States Patent [19]

Mehta et al.

[11] Patent Number: 5,772,399

[45] Date of Patent: Jun. 30, 1998

[54] APPARATUS AND METHOD FOR EFFICIENCY AND OUTPUT CAPACITY MATCHING IN A CENTRIFUGAL FAN

[75] Inventors: Pravinchandra C. Mehta, Clarksville, Tenn.; William A. Smiley, III, La Crosse, Wis.

[73] Assignee: American Standard Inc., Piscataway, N.J.

[21] Appl. No.: 171,149

[22] Filed: Dec. 21, 1993

[51] Int. Cl.[6] ..... F04D 29/18

[52] U.S. Cl. ..... 415/148; 415/158; 415/914

[58] Field of Search ..... 415/148, 150, 415/158, 182.1, 206, 208.1, 208.2, 208.3, 211.2, 914

[56] References Cited

U.S. PATENT DOCUMENTS

| | | | |
|---|---|---|---|
| 2,015,210 | 9/1935 | Witzel | 230/128 |
| 2,155,631 | 4/1939 | Anderson | 230/132 |
| 2,335,734 | 11/1943 | Caldwell | 230/134 |
| 2,452,274 | 10/1948 | Walters | 230/132 |
| 2,776,088 | 1/1957 | Wentling | 230/117 |
| 2,834,535 | 5/1958 | Autry et al. | 415/148 |
| 2,895,666 | 7/1959 | Girdwood et al. | 230/117 |
| 2,951,630 | 9/1960 | Murphy | 230/114 |
| 3,191,851 | 6/1965 | Wood | 230/127 |
| 3,221,983 | 12/1965 | Trickler et al. | 230/127 |
| 3,332,612 | 7/1967 | Gross | 230/117 |
| 4,680,006 | 7/1987 | Fisher | 431/265 |
| 4,996,850 | 3/1991 | Boxum et al. | 415/148 |
| 5,092,136 | 3/1992 | Kang | 415/148 |
| 5,207,557 | 5/1993 | Smiley, III et al. | 415/157 |

*Primary Examiner*—John T. Kwon

*Attorney, Agent, or Firm*—William J. Beres; William O'Driscoll; Peter D. Ferguson

[57] ABSTRACT

An efficiency matching device and method. The efficiency matching device is utilized in combination with a centrifugal fan adapted to deliver an air mass flow through an air delivery system. The fan has a housing that defines an inlet port and an exit port. The fan additionally has an impeller disposed within the housing. The impeller draws air into the inlet port, accelerates the air, and discharges the air through the exit port. The efficiency matching device is shiftably carried within the exit port for selectively varying the area of the exit port such that the efficiency of the centrifugal fan can be varied to match the output efficiency of the fan to the desired air mass flow through the air delivery system.

15 Claims, 2 Drawing Sheets

FIG. 3
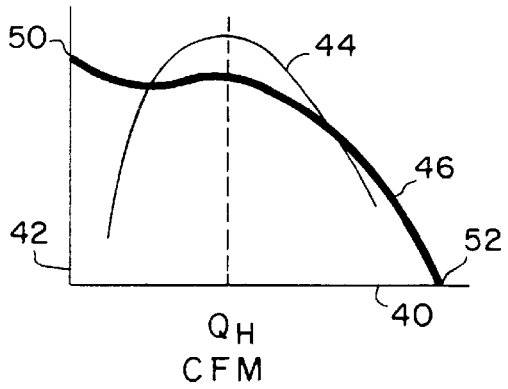
FIG. 4
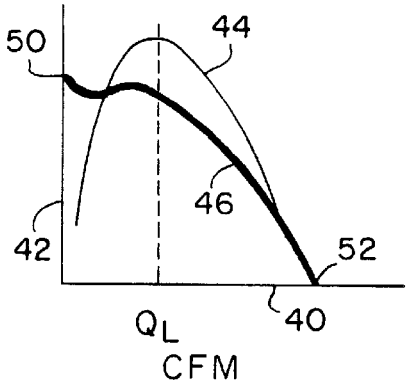
FIG. 5
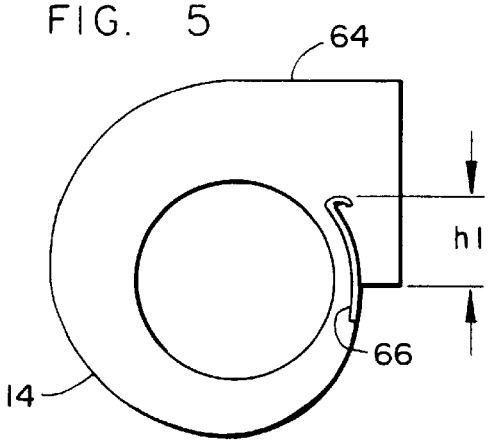
FIG. 6
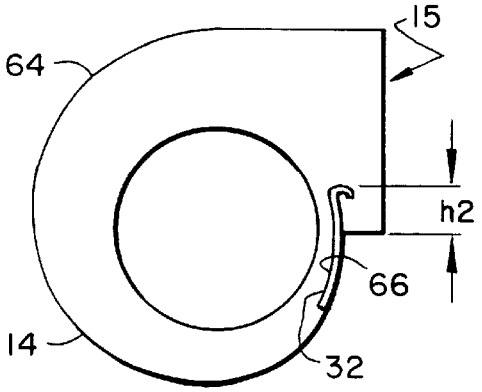
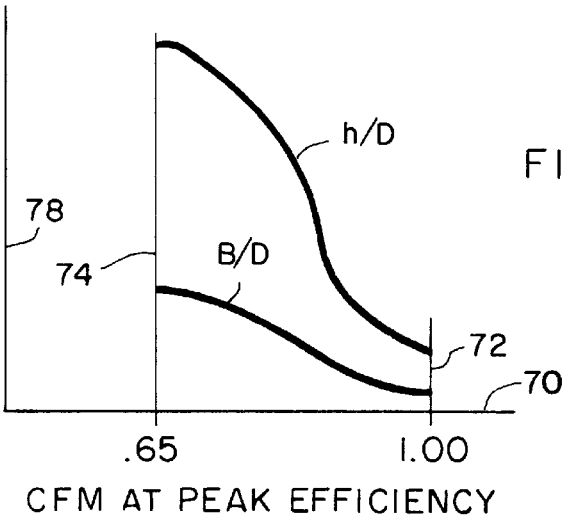
FIG. 7

APPARATUS AND METHOD FOR EFFICIENCY AND OUTPUT CAPACITY MATCHING IN A CENTRIFUGAL FAN

TECHNICAL FIELD

The present invention relates to centrifugal fans. More particularly, the present invention relates to an adjustable cutoff faring designed to match the efficiency of the fan to the specific airflow required to be produced by the fan in a variety of particular heating, ventilating and air conditioning (HVAC) system installations.

BACKGROUND OF THE INVENTION

Centrifugal fans are utilized in a wide variety of applications where efficient movement of air is required. In the air conditioning industry, for instance, centrifugal fans provide the energy to move air that has been either cooled or heated by the HVAC system through ducts and other apparatus that form the air delivery side of the HVAC system. Air movement may be generated by one or more fans. In certain applications, the fans are integral with the various components of an HVAC system, as for example, part of a single unit containing coils, filters, air exchangers, and the like. U.S. Pat. No. 5,207,557 to Smiley, III et al. assigned to the assignee of the present invention and hereby incorporated by reference, is exemplary of a centrifugal fan.

HVAC applications that incorporate centrifugal fan include rooftop units and air handlers.

The centrifugal fan has a circular impeller having a plurality of radially directed blades which generate airflow radial to the impeller shaft. The impeller blades are typically forward curved or backward curved relative to the direction of rotation. The impeller is mounted on a stub shaft which is in turn connected to an electric motor. The stub shaft may be an extension of the motor shaft or the motor may drive the impeller through a gearset or by means of a belt and pulleys.

The impeller is typically carried within a scroll shaped housing. The scroll shape housing surrounds the impeller and grows from having initially a very small cross sectional area to an air exit port that has relatively large cross sectional area. The exit is typically formed tangential to the circular impeller. A side of the housing has a large central inlet opening that is usually round. The central opening is connected with an air inlet into the center, interior, cavity portion of the impeller. The impeller draws the air into the cavity and accelerates the air, expelling the air at high velocity radially to the exterior of the impeller into the scroll shaped housing that surrounds the impeller. The high velocity air is then discharged through the exit port into the ducting that supplies the zones with air conditioned air.

The selection of the fan to be used is critical to the air conditioning system performance. Fan output performance must match air conditioning system air delivery requirements. Under such conditions, the pressure developed by the fan exactly matches the HVAC system resistance, and the fan output capacity equals the specified flow required by the HVAC system. If the flow rate produced by the fan is not equal to the requirements of the HVAC system, either the fan characteristics must be altered as by increasing the size of the fan or the HVAC system characteristics must be altered as by altering ducting or damper settings to affect the resistance presented by the HVAC system to the fan. For energy and cost efficiency, the fan must be operating at peak efficiency when it is operated at the desired capacity to match the needs of the particular HVAC system.

In the past, a particular fan was selected to match the capacity of the particular HVAC system into which the fan was being integrated. This meant that the manufacturer of air conditioning systems had to have a large inventory of fans of varying sizes in order to accommodate the varying applications of the HVAC systems. In order to reduce manufacturing costs and inventory requirements, it is desirable that as few different sized centrifugal fans as possible be required for utilization with varying capacity air conditioning systems. To accomplish this, a means is needed to expand the range of HVAC systems that a single fan unit can be made to service efficiently. Accordingly, an effective means is needed to vary the output of a given centrifugal fan over a wide range of output capacities and at the same time operate the fan at peak efficiency. This would allow for the standardization of fan housing sizes that are applicable to a range of applications of HVAC systems. It would also greatly reduce the inventory requirements necessary to ensure that a fan of suitable output is available during manufacture of the HVAC system.

In the past, there have been a number of problems with centrifugal fans wherein the potential solution to the specific problem seemed to lie in various extensions, walls, and panels inserted within the centrifugal fan. The first such problem was a manufacturing issue and dealt with assembling the fan impeller physically within the housing. Typically, the housing is constructed independent of the fan itself. The fan must then be inserted into and suitably fixed within the housing. This is usually done by inserting the fan in through the throat of the exit port. In order to have an exit area large enough to accommodate the fan comfortably, U.S. Pat. No. 2,776,088 and 3,332,612 have proposed a removable lip that extends between the underside of the exit and the beginning of the scroll housing. This lip is removed for insertion and assembly of the fan motor within the housing and then is put in place after the fan motor is in place and thereafter becomes a fixed component of the housing.

A second problem dealt with involves recirculation of air in the scroll housing. The problem is that air, accelerated by the fan, does not exit through the exit port, but instead continues to circulate with the impeller in the housing. Certain fan designs utilize an impeller that is substantially less than the width of the housing. In such designs, an inlet throat is utilized within the housing to span the distance between the impeller and the inlet opening in the side wall of the housing. The air recirculation may occur in the space around the exterior of this inlet throat in the space defined between the exterior of the throat and the interior of the scroll housing. In designs in which the width of the impeller is the same as the housing, the air recirculation may simply be through the interior of the scroll passageway within the scroll housing itself. In either event, panels have been utilized to close off the passageways through which this recirculation occurred. These panels were utilized to direct the flow of air out the exit port of the fan. Such types of panels are as proposed in U.S. Pat. Nos. 2,155,631, 2,452,274 and 3,221,983.

In a variation of the above problem, a lip, proposed in U.S. Pat. No. 2,015,210, is utilized to actually split the flow at the exit opening, encouraging the recirculation of a portion of the air accelerated by the fan. It was felt that a smooth aerodynamic extension of the scroll wall that formed the lower portion of the exit port from the fan was necessary in order to provide an orderly splitting of high velocity air at the exit between air that is actually exiting the fan and the air that is continuing in a rotational motion with the rotor. An alternative use of this device was to remove it from the housing as described above in order to permit the centrifugal fan motor to be inserted within the exit port throat during the manufacturing process.

U.S. Pat. No. 4,680,006 utilized an extension of the scroll wall into the exit port in conjunction with a second wall affixed in the interior of the squirrel cage type of fan to reduce whine and whistle from the blower operation. It was felt that the combination of the fixed cutoff faring or lip extension of the scroll wall and the interior wall created more stable air flow conditions, thereby reducing the aerodynamic noise generated by the operating fan.

Two U.S. Patents have purported to utilize cutoff farings to control the amount of air discharged from the fan. U.S. Pat. No. 2,335,734 utilizes a flexible gate that establishes the area of the fan exit. It is stated that the purpose of the gate is to regulate the volume of air discharged through the nozzle, although it appears from examination of the patent that the gate simply establishes a fixed area of the exit port. The idea expressed in the patent seems to rely on changes in the shape of the blade of the impeller to actually change the volume of air that is exiting the fan. This seems to be a complex solution to the problem of varying the fan capacity.

The second patent that utilizes a scroll wall cutoff faring in the furtherance of exit air control is U.S. Pat. No. 2,951,630. The '630 patent is concerned with the output volume of centrifugal fans. It varies the output volume principally by physically sliding the inlet nozzle off-center with respect to the center of the impeller. By thus varying the inlet nozzle the amount of inlet air is also varied. In an embodiment of the '630 patent, a hinged cutoff faring is connected by an arm to the inlet nozzle. The cutoff faring that is hinged to move in a manner much as a flapper valve or damper. As the inlet nozzle is slid back and forth, the connecting arm correspondingly opens and closes the cutoff faring more or less, thereby varying the area of the exit from the fan. Again, this is a complex solution to the problem of varying the output of the fan that involves moving both the location of the impeller inlet within the fan housing and simultaneously moving a flapper type lip extension in the exit area of the fan housing.

A simple device to make a one time match of the performance of the fan at peak efficiency to the varying capacity demands of a number of specific HVAC system prior to installations desirable to ensure the maximum energy efficiency of the HVAC system and at the same time reducing the manufacturing and inventory costs. Accordingly, it would be a decided advantage in the air conditioning industry to have advice that is capable of being adjusted at the time of installation of the fan in order to vary the exit area to match the performance of the fan to the characteristics of the air conditioning system. Such a simple expedient would allow the use of only a very limited number of standard sized fans to be used with air conditioning systems having widely varying capacities. By having just a limited number of standard sized fans the number of parts is greatly reduced while still being able to efficiently achieve the fan capacities necessary for the varying sized air conditioners.

SUMMARY OF THE INVENTION

The present invention meets the requirements of utilizing a medium sized fan for many different air conditioning system capacity air mass volume requirements from a relatively high capacity to a relatively low capacity. A medium sized fan utilizing the present invention is capable of providing efficient output under high air flow requirements as well as providing efficient output at low air flow requirements. The fan operates at peak efficiency for all applications throughout the range from the highest to the lowest capacities. This is accomplished by varying the fan exit area.

The present invention utilizes a cutoff faring or lip in the exit port. The cutoff faring is formed as an extension of the curve of the outside scroll wall into the exit port. The scroll wall forms the outside of the centrifugal fan housing. The cutoff faring preferably has a turned over lip directed downstream in the airflow to provide a smooth aerodynamic transition, such that the high speed air exiting the fan is not affected by a sharp edge. This acts to reduce the generation of turbulence in the exit air.

The cutoff faring is movable so that it may be extended various distances into the area of the exit throat. The cutoff faring is formed in a curved manner that extends the involute curve of the scroll housing into the exit area. While the cutoff faring of the present invention is variable over a considerable range of positions to significantly alter the area of the fan exit, the cutout is preferably set in a position that defines a desired air flow under the desired fan operating conditions and fixed in that condition for operation of the HVAC system. The cutoff faring is set to provide air output from the fan matched to the requirements of the specific HVAC system serviced at peak fan efficiency.

BRIEF DESCRIPTION OF THE DRAWINGS

FIG. 3 is an operating characteristic diagram of a medium fan utilized in the high air flow condition with the cutoff faring of the present invention in position one as depicted in FIG. 4.

FIG. 4 is an operating characteristic diagram of a medium fan used in a low air flow condition with the cutoff faring in condition to as depicted in FIG. 5.

FIG. 5 is a diagrammatic side view of a centrifugal blower with the cutoff faring in position utilized for high air flow.

FIG. 6 is a diagrammatic side view of a centrifugal blower with the cutoff faring in position utilized for low air flow.

FIG. 7 is a graph of mass flow versus cutoff location.

DETAIL DESCRIPTION OF THE DRAWINGS

Figure 1:
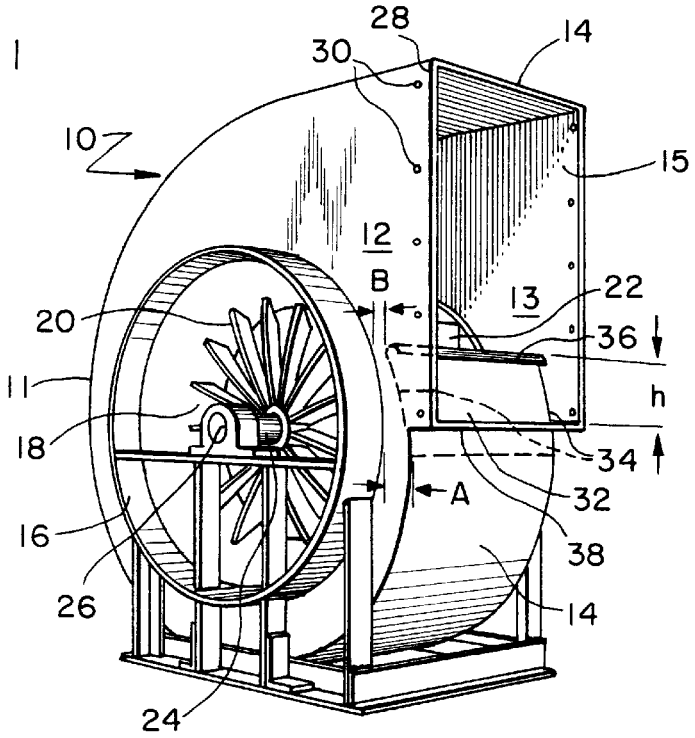
FIG. 1 is a perspective view of a centrifugal fan incorporating the variable cutoff faring of the present invention.

A centrifugal fan is shown generally at 10 in FIG. 1. The centrifugal fan 10 has a housing 11 generally in a scroll shape. The housing 11 is formed of sidewalls 12, 13, spaced apart by a scroll wall 14. The scroll shaped housing 11 is formed in an involute curve and begins with a narrow scroll section as indicated at arrows A. The scroll of the housing 11 gradually expands in clockwise manner toward an exit opening 15. The housing 11 is generally constructed of sheet metal material in a conventional manner.

A large intake opening 16 is provided in the sidewall 12 of the centrifugal fan 10. The intake opening 16 preferably has a bell mouth shaped intake 18. The bell mouth 18 decreases end diameter as it directs air flow inward into centrifugal fan 10. In the preferred embodiment shown, inlet guide vanes 20 cooperate with bell mouth intake 18 to direct a stream of intake air into centrifugal fan 10.

A squirrel cage type impeller 22 is contained within the centrifugal fan 10. The impeller 22 has generally radially shaped blades that accelerate the air flow radially outward into the scroll shaped housing 12. Rotation of the impeller 22 in the centrifugal fan 10 as depicted in FIG. 1 will be in a clockwise direction.

Mode of power for the impeller 22 is not shown, but is located on the far side of the centrifugal fan 10 adjacent the sidewall 13 and typically comprises an electrical motor. The electrical motor drives a stub axle 24 connected to the impeller 22. The drive is typically directly from the output shaft of the electric motor, but may be via a gearset or through a belt and pulley arrangement. The stub axle 24 is rotationally borne in a conventional manner in bearings 26.

The exit port 15 is preferably rectangular in shape and is adapted to be connected directly to sheet metal duct work (not shown) for conveying the flow of air discharged from the fan 10 to the zone or space being cooled or heated, as the case may be. A flange 28 with suitable bores 30 formed therein is provided in order to facilitate connecting the duct work to the exit port 15 of the centrifugal fan 10.

Cutoff faring 32 is shown partially obstructing the exit port 15. The cutoff faring 32 covers the full width of exit port 15 and is therefore coextensive with wall 13. The cutoff faring 32 is curved as indicated at sides 34 to continue the curve of the scroll wall 14. The cutoff faring 32 is slideable along the interior surface of the scroll wall 14. By being of slideable construction, the cutoff faring 32 may be extended a greater or lesser distance into the exit port 15 as desired. The variable distance that the cutoff faring 32 is extended into the exit port 15 is depicted as distance, h, in FIG. 1. The distance, h, is measured from a lateral edge 38 of the scroll wall 14 to an upper edge 36 of the cutoff faring 32.

Since the cutoff faring 32 is a continuation of the scroll curve of wall 14, the further that the cutoff faring 32 is introduced into an exit port 15, the closer that leading upper edge 36 comes to the outer periphery of the impeller 22. Thus, the distance defining the throat formed between the cutoff faring 32 and the impeller 22 shown by the arrows B at the full extension of the cutoff faring 32 is less than the distance shown by the arrows A.

The upper edge 36 has an outward projecting curl in the direction of flow of discharge air from the fan 10. The curl upper edge 36 presents an aerodynamic shape to generate a separation of flow of the air coming off of the impeller 22 into a stream of air that exits the fan 10 and a stream of air that is recirculated within the area defined between the housing 11 and the impeller 22.

FIGS. 2*a*, 2*b*, 3, and 4 represent graphs of fan operating characteristics. The ordinate 40 of each of the graphs is mass flow Q in cubic feet per minute (CFM). Usually, mass flow is the product of air density, area of the orifice through which the flow is measured, and the velocity of the air flow through the orifice. For the purposes of HVAC systems, the convention is to ignore the density of the air since the region of measurement does not involve any compressibility effects that make air density significant to a useable quantity. The air flow then is reduced to the product of orifice area and velocity and is expressed in cubic feet per minute.

The abscissa 42 of each of FIGS. 2*a*, 2*b*, 3, and 4 has two scales, a static efficiency curve 44 and a static pressure curve 46. Static efficiency 44 is measured as a percentage of the maximum theoretically possible. In practice, a well designed fan might attain 60 percent efficiency. The second scale, static pressure 46, is usually calibrated in inches of water. Static pressure is an indication of the work that the fan can perform. The greater the static pressure, the greater the work. The HVAC operating point will be somewhere between the conditions of zero airflow and maximum airflow. Zero air flow is a blocked tight condition occurring, for example, if the fan is attempting to discharge air into a sealed vessel. Zero air flow is depicted at an intersection 50 of the static pressure curve 46 and the abscissa 42. Maximum air flow is a wide open air flow where the fan 10 is discharging air with no back pressure freely into the atmosphere and is depicted at am intersection 52 of the static pressure curve 46 and the ordinate 40. At the operating point, where there is a certain amount of back pressure that the fan must operate against and a certain mass flow that is determined by the physical characteristics of the particular HVAC system being served.

Figure 2A:
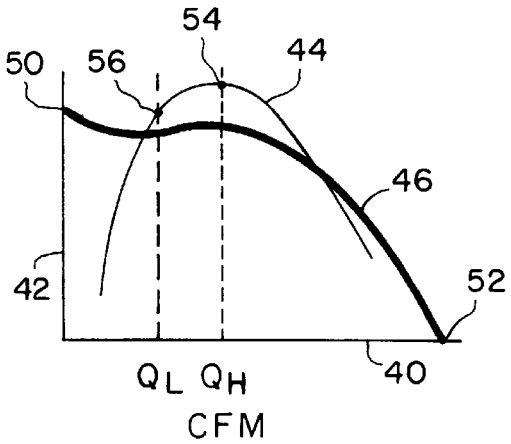
FIG. 2*a* is an operating characteristic diagram of a large centrifugal fan utilized for both high and low air flow requirements.
Figure 2B:
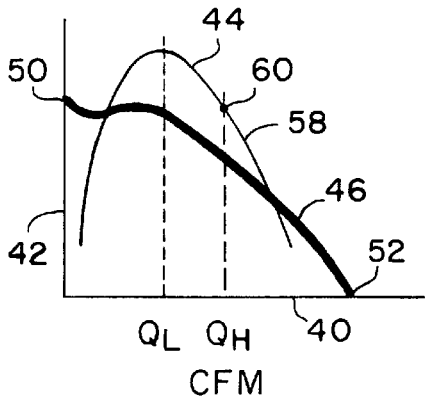
FIG. 2*b* is an operating characteristic diagram of a small fan used for both high and low air flow requirements.

FIGS. 2*a* and 2*b* illustrate the effects of trying to match a single sized fan to two particular applications having varying mass flow requirements. FIG. 2*a* is a depiction of the operating characteristics of a large capacity fan. In applications where the mass flow requirements QH are high, a large fan is operating in an area of high efficiency as indicated by a peak 54 of the efficiency curve 44. When that same fan is utilized in an application requiring a low mass flow as indicated at QL, it is seen that the large fan is operating at an area 56 of less than peak efficiency. The area 56 of operation for the fan at QL is in fact an area 56 of unsatisfactory operation for a fan. This area 56 produces a condition in the fan known as surge. In this area 56, the blades 22 of the fan 10 experience aerodynamic stall and the operation of the fan 10 is very unstable. For such an operating condition, there is no current practical solution other than by passing air or utilizing a smaller sized fan for an HVAC application that has the lower mass flow requirements.

In FIG. 2*b*, a small fan functions at high efficiency in applications where the mass flow is low as indicated at QL. The small fan could be utilized in an application requiring a high mass flow, as indicated at QH and the region 58 to the right of the point 60 of peak efficiency is an acceptable region of fan operation. The major drawback to operation in the region 58 is that the small fan is operating at substantially less than peak efficiency. This results in a higher operating cost to the user.

The solution provided by the present invention to the previously described problem is as illustrated in FIGS. 3 through 6. FIGS. 3 through 6 all apply to the same fan 10, designated a medium sized fan 64 for purposes of this application and in relation to the small and large fans of which the operating characteristics are depicted in FIGS. 2*a* and 2*b*. The efficiency and the output of the medium fan 64 as depicted graphically in FIGS. 3 and 4. The geometry of the medium size fan 64 is controlled by the present invention as depicted in FIGS. 5 and 6. FIG. 3 depicts the operating characteristics of the medium size fan 64 for high airflows. The small and large fans define the operating extremes, as far as volumes of air flow are concerned, for a variety of air conditioning systems applications. FIG. 3 illustrates the use of the medium sized fan 64 to provide the high mass flow required at the extreme high end of the spectrum and yet retain the peak fan efficiency.

By utilizing the efficiency matching device of the present invention, the same medium sized fan 64 can be utilized both for applications requiring the low mass flow depicted in FIGS. 4 and 5 and in applications requiring the high mass flow depicted in FIGS. 3 and 6. FIG. 3 illustrates the fact that utilizing a medium sized fan configured as indicated in FIG. 6, the efficiency of the medium sized fan is matched to the requirements of the HVAC system where high mass flows, QH, are required. The depiction of FIG. 6 shows the cutoff faring 22 in its lowest position, with the distance between the edge 36 of the cutoff faring 22 and the edge 38 of the housing 12, indicated at H2, being a relatively small distance. This orientation of cutoff faring 32 provides for the largest possible area at the exit port 15 and provides for the maximum amount of accelerated air exiting the centrifugal fan 10 through the exit port 15. The fact that the area of the exit port 15 is at the maximum size means that there is less resistance to the air flow from the fan 10. This extends the static pressure curve, SP, further to the right where the wide open air flow is at a greater mass air flow.

FIG. 4 illustrates the operating characteristics of the medium sized fan 64 as but for applications requiring low mass flow, QL, while retaining peak efficiency. Effectively, the peak efficiency of the medium sized fan 64 has been matched to the mass flow requirements of the smaller HVAC system.

The operating characteristics of FIG. 4 are accomplished, as depicted in FIG. 5, when the cutoff faring 32 is extended into the throat of the exit port 15 to the fullest possible extent. A distance, H1, defines the height from the edge 38 of the wall 14 to the edge 36 of the cutoff faring 32 when the cutoff faring 32 is in its fully extended position. Accordingly, H1 as depicted in FIG. 5 is a relatively large distance. By moving cutoff faring 32 to the position depicted in FIG. 5, the area of the exit port 15 is substantially reduced. This reduction in area causes a relatively higher portion of the air accelerated by the fan 10 to be recirculated within the housing 11 of the fan 10. The recirculated air is captured by an inner face 66 of the cutoff faring 32 and retained within the scroll housing 11 of the centrifugal fan 10. It should be noted that with the cutoff faring 32 fully inserted into the exit port 15, the resistance to air flow by the fan 10 is increased. This causes the static pressure, SP, of the fan to compress to the left as depicted in FIG. 4. The result is that the fan arranged as in FIG. 4 is able to generate less air flow at wide open conditions as compared to the flow possible with the arrangement depicted in FIG. 3.

FIG. 7 is useful in analyzing the range of operations over which the efficiency matching that is possible with the cutoff faring 32 is practically effective. The ordinate 70 of the graph depicted in FIG. 7 is scaled in mass flow and varies for specific fans of varying sizes. The distance, B, is the distance at the throat formed by the cutoff faring 32 between the edge 35 of the cutoff faring 32 and the outer diameter of the impeller 22, as depicted in FIG. 1. The abscissa 78 depicts the cutoff location as determined by the distance h. The distance h is the variable distance that the cutoff faring 32 projects into the exit port 15. The dimension, D, is the diameter of the impeller 22. The two curves, h/D and B/D are dimensionless curves that are useful in positioning cutoff faring 32 to match the fan efficiency to the mass flow requirements of the HVAC system. Using the described definitions, the range of h/D is generally 0.10 to 0.39 and the range of B/D is generally 0.08 to 0.11.

In the general example depicted, the maximum and minimum mass flows are shown as a percent of one another. This illustrates that the practical limits of efficiency matching utilizing the present invention range from a maximum, depicted at line 72 as 1.00, to a minimum, depicted at line 74 as 0.65, that is generally thirty-five percent less than the maximum. Accordingly, a single fan can be utilized efficiently over a thirty-five percent variance in mass flow requirements using the simple expedient of the device of the present invention to match the efficiency of the fan to the specific mass flow requirements within that range.

In operation, the operating characteristics of the HVAC system are calculated. Considerations include the rated tonnage of the refrigeration unit and the nature of the duct system that delivers the chilled or heated air to the zone that is being air conditioned. The duct system creates a back pressure that is a result of the length of the duct runs, the area dimensions of the duct and the configuration of the ductwork, including turns, baffles, and other restrictions to the passage of the conditioned air therethrough. Consideration of these factors defines an air mass output required to adequately service the zone. This requirement defines the mass flow that the fan 10 must be capable of operating at. The cutoff faring 32 is then positioned during installation of the HVAC system in the building that will be served to provide the specified air mass flow and at the same time function at the peak efficiency. The cutoff faring 32 is positioned at the positions defined by H1 and H2 or any position in between as required by the particular application. This position is fixed at the time of installation. Changing the position of the cutoff faring 32 is possible after installation but the need for such changes is not foreseen.

Although a certain specific embodiment of the present invention has been shown and described, it is obvious that many modifications and variations thereof are possible in light of these teachings. It is to be understood therefore that within the scope of the appended claims, the invention may be practiced otherwise than as specifically described herein.

What is claimed is:

1. A centrifugal fan for generating a desired air mass flow through an air delivery system, said fan being adapted to operate over a range of varying air mass flow rates at varying efficiencies, and having a scroll shaped housing formed by a first side member and a second side member spaced apart by a wall member having a first end and a second end, the side members adapted for rotationally supporting a circular impeller therein, the impeller having a plurality of blades defining an interior air cavity, the impeller accelerating the air in said cavity through rotational motion of the blades and discharging the accelerated air to the exterior of the impeller through an exit port, the first side member having an air inlet therethrough defining an inlet air passageway to the interior air cavity, the housing defining an air passageway exterior to the impeller, the air passageway expanding in cross sectional area through a portion of a revolution around the impeller commencing with a cross sectional area of reduced size and expanding to define the exit port of substantially greater cross sectional area, the centrifugal fan having:

a cutoff faring operable and slideable along an interior surface of the scroll housing and located at an end of the scroll housing proximate the air passageway's minimum cross section area, the cutoff faring being shiftably carried within the exit port for selectively varying the area of the exit port such that the efficiency of the centrifugal fan is varied to match the output efficiency of the fan to the desired air mass flow through the air delivery system.

2. The invention as claimed in claim 1 wherein the cutoff faring is effective to match the peak efficiency of the fan to the desired air mass flow rate over a range of desired air mass flows having a thirty-five percent differential between the maximum air mass flow rate and the minimum air mass flow rate.

3. The invention as claimed in claim 1 wherein the cutoff faring is adapted to project from the wall member into the exit port a selectable distance and having a lip defining the limit of projection of the cutoff faring into the exit port.

4. The invention of claim 3 wherein the cutoff faring is adapted for varying the area of the exit port between a minimum area and a maximum area defined to produce a desired minimum air mass flow and a maximum air mass flow from the centrifugal fan while operating the centrifugal fan at maximum efficiency.

5. The invention of claim 3 wherein the cutoff faring defines a scroll segment of generally the same curvature as the wall member of the housing proximate the first end of the wall member and wherein the cutoff faring includes a lip that comprises the furthermost portion of the cutoff faring projecting into the exit port and wherein the farther the cutoff faring is introduced into the exit port, the closer the lip comes to an outer periphery of the impeller.

6. The invention of claim 3 wherein, the lip has a curvature of relatively small diameter that is reverse that of the scroll segment of the cutoff faring, the curved lip presenting a generally smooth aerodynamic surface to the air mass that is exiting the exit port.

7. The invention as claimed in claim 6 wherein the cutoff faring is effective to alter the efficiency curve of the fan to prevent the occurrence of surge conditions at the lower mass flow rates required to be delivered.

8. In combination with a centrifugal fan adapted to deliver an air mass flow rate through an air delivery system, the fan having a scroll shaped housing defining an inlet port and an exit port and an impeller disposed within the housing, the impeller drawing air into the inlet port, accelerating the air, and discharging the air through the exit port, a cutoff faring shiftably carried within the exit port for selectively varying the area of the exit port such that the efficiency of the centrifugal fan is varied in order to match the output efficiency of the fan to the desired air mass flow rate through the air delivery system wherein the scroll shaped fan housing has first and second spaced apart side members joined by a wall member, the distance between the wall member and the impeller increasing from a first wall member area to a second wall member area, and wherein the cutoff faring is operably and slideably coupled to the wall member of the housing proximate the first wall member area and is adapted to project from the wall member into the exit port a selectable distance and having a lip defining the limit of projection of the cutoff faring into the exit port.

9. The invention as claimed in claim 8 wherein the cutoff faring is effective to match the peak efficiency of the fan to the desired air mass flow rate over a range of desired air mass flows having a thirty-five percent differential between the maximum air mass flow rate and the minimum air mass flow rate.

10. The invention of claim 8 wherein the cutoff faring is adapted for varying the area of the exit port between a selected minimum area and a maximum area defined to produce a desired minimum air mass flow and a maximum air mass flow from the centrifugal fan while operating the centrifugal fan at maximum efficiency at both the minimum air mass flow and the maximum air mass flow and therebetween.

11. The invention of claim 8 wherein the wall member of the housing defines an involute scroll about the impeller and wherein the cutoff faring defines a scroll segment of generally the same curvature as the wall member of the housing, the cutoff faring disposed to form an extension of the first end of the wall member.

12. The invention of claim 11 wherein the cutoff faring includes a lip that comprises the furthermost portion of the cutoff faring projecting into the exit port, the lip having a curvature of relatively small diameter that is reverse that of the scroll segment of the cutoff faring, the curved lip presenting a generally smooth aerodynamic surface to the air mass that is being discharged from the exit port.

13. The method of optimizing the performance characteristics of a specific centrifugal fan for various air mass flow rates, the centrifugal fan discharging an air mass volume through an exit port, the exit port having a shiftable efficiency matching apparatus disposed therein including the steps of:

determining the desired air mass flow rate required for the particular application in which the centrifugal fan is to be operated;

generating a separation of the flow of air from the fan into an exiting airstream and a recirculating airstream;

sliding the efficiency matching apparatus along a scroll shaped housing of the fan; and positioning the shiftable efficiency matching apparatus in the exit port and vary the area of the exit port to achieve the peak efficiency of the centrifugal fan at the desired air mass flow rate.

14. The method as claimed in claim 12 wherein positioning the efficiency matching apparatus is effective to match the peak efficiency of the fan to the desired air mass flow rate over a range of desired air mass flows having a thirty-five percent differential between the maximum air mass flow rate and the minimum air mass flow rate.

15. The method as claimed in claim 13 wherein positioning the efficiency matching apparatus is effective to alter surge conditions at the lower air mass flow rates required to be delivered.

* * * * *